US009291923B2

(12) United States Patent
Nukada et al.

(10) Patent No.: US 9,291,923 B2
(45) Date of Patent: Mar. 22, 2016

(54) ELECTROPHOTOGRAPHIC PHOTORECEPTOR, PROCESS CARTRIDGE, AND IMAGE FORMING APPARATUS

(71) Applicant: FUJI XEROX CO., LTD., Minato-ku, Tokyo (JP)

(72) Inventors: Hidemi Nukada, Kanagawa (JP); Shigeto Hashiba, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/479,641

(22) Filed: Sep. 8, 2014

(65) Prior Publication Data

US 2015/0268569 A1 Sep. 24, 2015

(30) Foreign Application Priority Data

Mar. 19, 2014 (JP) ..... 2014-056584

(51) Int. Cl.
*G03G 5/14* (2006.01)
*G03G 5/04* (2006.01)

(52) U.S. Cl.
CPC ... *G03G 5/14* (2013.01); *G03G 5/04* (2013.01)

(58) Field of Classification Search
CPC ..... G03G 5/028; G03G 5/0507; G03G 5/06; G03G 5/144
See application file for complete search history.

(56) References Cited

U.S. PATENT DOCUMENTS

| | | | | |
|---|---|---|---|---|
| 5,298,617 | A | 3/1994 | Nukada et al. | |
| 5,302,479 | A | 4/1994 | Daimon et al. | |
| 5,459,004 | A | 10/1995 | Daimon et al. | |
| 2006/0216619 | A1* | 9/2006 | Iwasaki | G03G 5/0605 430/58.75 |
| 2009/0226208 | A1* | 9/2009 | Nukada | G03G 5/0539 399/111 |
| 2014/0045110 | A1* | 2/2014 | Matsuki | G03G 5/08 430/56 |

FOREIGN PATENT DOCUMENTS

| | | | |
|---|---|---|---|
| EP | 0 710 893 | A1 | 5/1996 |
| JP | 4-189873 | A | 7/1992 |
| JP | 5-098181 | A | 4/1993 |
| JP | 05-140472 | A | 6/1993 |
| JP | 05-140473 | A | 6/1993 |
| JP | 5-263007 | A | 10/1993 |
| JP | 5-279591 | A | 10/1993 |
| JP | 8-176293 | A | 7/1996 |
| JP | 08-208820 | A | 8/1996 |
| JP | 2004-078147 | A | 3/2004 |
| JP | 2005-115351 | A | 4/2005 |
| JP | 2005-181992 | A | 7/2005 |
| JP | 2005-189843 | A | 7/2005 |
| JP | 2012-155282 | A | 8/2012 |

* cited by examiner

*Primary Examiner* — Hoa V Le
(74) *Attorney, Agent, or Firm* — Sughrue Mion, PLLC

(57) ABSTRACT

An electrophotographic photoreceptor includes a cylindrical conductive substrate, an undercoat layer containing a cured product of a resin and a blocked isocyanate and being disposed on the conductive substrate, and a photosensitive layer on the undercoat layer. The degree of curing of the undercoat layer defined by the equation below is about 1.5 or less in both a region A and a region B defined below:

Region A (B): A region between a position distant from a first (second) end of the conductive substrate by about ⅛ of a length of the conductive substrate and a position distant from the first (second) end of the conductive substrate by about ⅕ of the length of the conductive substrate Degree of curing=[Amount (g) of blocking agent separated from blocked isocyanate in undercoat layer]/weight of undercoat layer (g)×100.

10 Claims, 3 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2014-056584 filed Mar. 19, 2014.

BACKGROUND (i) Technical Field

The present invention relates to an electrophotographic photoreceptor, a process cartridge, and an image forming apparatus.

(ii) Related Art

Electrophotographic image forming apparatuses produce images of high printing quality at high speed and are used in image forming apparatuses such as copiers and laser beam printers. The mainstream photoreceptor used in the image forming apparatuses is organic photoreceptors that use organic photoconductive materials. An organic photoreceptor is typically produced by, for example, forming an undercoat layer on a base composed of aluminum or the like, and then forming a photosensitive layer, in particular, a photosensitive layer including a charge generation layer and a charge transport layer.

SUMMARY

An exemplary embodiment provides an electrophotographic photoreceptor that includes a cylindrical conductive substrate, an undercoat layer containing a cured product of a resin and a blocked isocyanate and having a degree of curing of about 1.5 or less in both a region A and a region B defined below, the degree of curing being determined from an equation below, and a photosensitive layer. The undercoat layer is disposed on the cylindrical conductive substrate and the photosensitive layer is disposed on the undercoat layer.

Region A: A region that lies between a position distant from a first end of the conductive substrate by ⅛ or about ⅛ of a length of the conductive substrate toward a center portion in an axis direction and a position distant from the first end of the conductive substrate by ⅕ or about ⅕ of the length of the conductive substrate toward the center portion in the axis direction Region B: A region that lies between a position distant from a second end of the conductive substrate by ⅛ or about ⅛ of the length of the conductive substrate toward the center portion in the axis direction and a position distant from the second end of the conductive substrate by ⅕ or about ⅕ of the length of the conductive substrate toward the center portion in the axis direction Degree of curing=[Amount (g) of blocking agent separated from blocked isocyanate in undercoat layer]/weight of undercoat layer (g)×100.

BRIEF DESCRIPTION OF THE DRAWINGS

Exemplary embodiments of the present invention will be described in detail based on the following figures, wherein.

DETAILED DESCRIPTION

Figure 1:
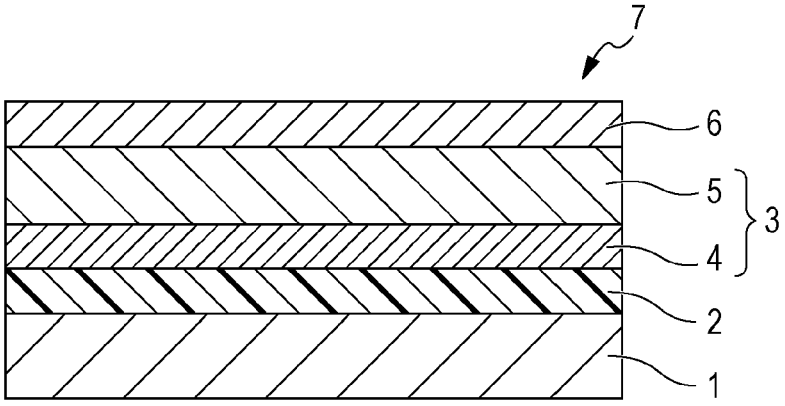
FIG. 1 is a schematic view of an example of a layer structure of an electrophotographic photoreceptor according to an exemplary embodiment.

Exemplary embodiments according to the present invention will now be described in detail.

<Electrophotographic Photoreceptor>

An electrophotographic photoreceptor according to an exemplary embodiment includes a cylindrical conductive substrate, an undercoat layer containing a cured product of a resin and a blocked isocyanate and having a degree of curing of about 1.5 or less in both a region A and a region B defined below, the degree of curing being determined from an equation below, and a photosensitive layer. The undercoat layer is disposed on the cylindrical conductive substrate and the photosensitive layer is disposed on the undercoat layer.

Region A: A region that lies between a position distant from a first end of the conductive substrate by ⅛ or about ⅛ of a length of the conductive substrate toward a center portion in an axis direction and a position distant from the first end of the conductive substrate by ⅕ or about ⅕ of the length of the conductive substrate toward the center portion in the axis direction Region B: A region that lies between a position distant from a second end of the conductive substrate by ⅛ or about ⅛ of the length of the conductive substrate toward the center portion in the axis direction and a position distant from the second end of the conductive substrate by ⅕ or about ⅕ of the length of the conductive substrate toward the center portion in the axis direction Degree of curing=[Amount (g) of blocking agent separated from blocked isocyanate in undercoat layer]/weight of undercoat layer (g)×100.

The electrophotographic photoreceptor according to the exemplary embodiment can suppress a decrease in image density determined by the size of dots after repeated use because the electrophotographic photoreceptor has the aforementioned structure. The reason for this is not clear but is presumably as follows.

An undercoat layer of an electrophotographic photoreceptor is usually a resin film that contains a resin. In such a case, charge transfer inside the resin film occurs due to the ion conductivity of moisture and ionic substances contained in the resin film.

However, once some charges remain trapped in the resin film, the charges accumulate as the electrophotographic photoreceptor is repeatedly used, resulting in a local increase in residual potential. This sometimes results in a decrease in image density determined by the size of dots at that region.

The inventors have conceived that residual charges in the undercoat layer may be suppressed by forming conductive paths through which smooth charge transfer is carried out and decreasing the number charge traps in the film and that the decrease in image density determined by the size of dots is suppressed as a result, and have obtained the following findings.

That is, controlling the degree of curing of the undercoat layer suppresses accumulation of the residual potential and suppresses the decrease in image density determined by the size of dots.

Due to these reasons, in the electrophotographic photoreceptor according to the exemplary embodiment, the degree of curing of the undercoat layer is controlled in the end portions (regions A and B) of the undercoat layer where the decrease in image density determined by the size of dots is particularly frequent.

Presumably as a result, accumulation of residual potential at the two end portions (regions A and B) of the undercoat layer is suppressed and the decrease in image density determined by the size of dots after repeated use is suppressed.

Since the decrease in image density determined by the size of dots is suppressed in the two end portions of the undercoat layer where the decrease in image density determined by the size of dots is frequent, the in-plane nonuniformity in the image density determined by the size of dots may also be suppressed even after the repeated use.

The structure of the photoreceptor of according to an exemplary embodiment will now be described with reference to FIG. 1. FIG. 1 is a schematic diagram of an example of a layer structure of the photoreceptor according to the exemplary embodiment.

An electrophotographic photoreceptor 7 illustrated in FIG. 1 includes a photosensitive layer 3 of a separated function type, in which a charge generation layer 4 and a charge transport layer 5 are separately provided. An undercoat layer 2, the charge generation layer 4, the charge transport layer 5, and a protective layer 6 are stacked in that order on a cylindrical conductive substrate 1. The undercoat layer of the aforementioned exemplary embodiment is used as the undercoat layer 2.

Structural elements of the electrophotographic photoreceptor 7 illustrated in FIG. 1 are described below. The structure of the electrophotographic photoreceptor according to the exemplary embodiment is not limited to the structure described below.

For example, an integrated photosensitive layer that has functions of both a charge generation layer and a charge transport layer may be provided. Moreover, an intermediate layer may be disposed between the undercoat layer and the photosensitive layer. The protective layer which forms the outermost layer need not be always provided.

In the description below, reference numerals are omitted.

[Conductive Substrate]

First, a cylindrical conductive substrate is described. The term "conductive" means that the volume resistivity is less than $10^{13}$ Ω·cm, for example.

The cylindrical conductive substrate may be any one of conventionally used cylindrical conductive substrates.

Examples thereof include a metal drum composed of aluminum, copper, iron, stainless steel, zinc, nickel, or the like; a cylindrical member prepared by vapor-depositing a metal, such as aluminum, copper, gold, silver, platinum, palladium, titanium nickel-chromium, stainless steel, or indium or a conductive metal compound such as indium oxide or tin oxide onto a substrate such as a sheet, a paper sheet, a plastic substrate, or a glass substrate; a cylindrical member prepared by laminating a metal foil onto the substrate; and a cylindrical member prepared by applying a dispersion of carbon black, indium oxide, tin oxide, antimony oxide power, metal powder, copper iodide, or the like in a binder resin onto the substrate to make the substrate electrically conductive.

The conductive substrate used in the exemplary embodiment may be subjected to a surface treatment. The surface treatment may be any known surface treatment such as mirror cutting, etching, anodizing, rough cutting, centerless grinding, sand blasting, or wet honing.

[Undercoat Layer]

The undercoat layer of the exemplary embodiment is a layer that contains, as a binder resin, a cured product obtained by curing a resin and a blocked isocyanate.

The cured product is described first.

(Blocked Isocyanate)

A known isocyanate to which a known blocking agent is added is used as the blocked isocyanate. Examples of the blocking agent include include phenols, alcohols, dimethyl malonate, ethyl acetoacetate, dimethylpyrazole, methyl ethyl ketone (MEK) oxime, ε-caprolactam.

The isocyanate to which the blocking agent is added may be any known isocyanate that offers desirable properties. Examples of the isocyanate include tolylene diisocyanate (TDI), diphenylmethane diisocyanate (MDI), hexamethylene diisocyanate (HDI), and isophorone diisocyanate (IPDI) and dimers, trimers, etc., thereof.

Among these, hexamethylene diisocyanate to which MEK oxime is added as a blocking agent may be used since this blocking agent has a low boiling point and rarely remains in the cured film. A specific example of the blocked isocyanate is Sumidur BL 3175 (produced by Sumitomo Bayer Urethane Co., Ltd.).

(Resin)

Any known resin may be used as the resin that forms a cured product with the blocked isocyanate. Examples of the resin include acetal resins such as a polyvinyl butyral resin, polyvinyl alcohol resins, casein, polyamide resins, cellulose resins, gelatin, polyurethane resins, polyester resins, polyether resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, unsaturated urethane resins, polyester resins, alkyd resins, epoxy resins, and other known polymer resin compounds. A charge transport resin having a charge transport group or an electrically conductive resin such as polyaniline may also be used.

In particular, polyvinyl butyral resins, polyvinyl alcohol resins, and the like are preferable from the viewpoint of reactivity with the blocked isocyanate.

The resins may be used alone or in combination.

The blend ratio of the blocked isocyanate to the resin may be that the ratio of the NCO equivalent of the blocked isocyanate to the OH equivalent of the resin is in the range of 1.0 to 2.0. At an NCO equivalent/OH equivalent ratio less than 1, unreacted OH groups in the resin remain in the cured film and act as charge traps. Thus there is a concern that the residual potential may increase in long-term operation. At an NCO equivalent/OH equivalent ratio exceeding 2, re-blocking for the OH groups that did not react with the resin and the reaction with the ambient moisture readily occur. Thus there is a concern that the recombined parts of the blocking agent and the part that reacted with the ambient moisture act as charge traps and the residual potential may readily increase during long-term operation.

(Degree of Curing)

A region a and a region B of the undercoat layer from which the degree of curing is determined will now be described.

In the exemplary embodiment, the "region A and region B" are as follows:

Region A: A region that lies between a position distant from a first end of the conductive substrate by ⅛ or about ⅛ of the length of the conductive substrate toward the center portion in the axis direction and a position distant from the first end of the conductive substrate by ⅕ or about ⅕ of the length of the conductive substrate toward the center portion in the axis direction Region B: A region that lies between a position distant from a second end of the conductive substrate by ⅛ or about ⅛ of the length of the conductive substrate toward the center portion in the axis direction and a position distant from the second end of the conductive substrate by ⅕ or about ⅕ of the length of the conductive substrate toward the center portion in the axis direction.

For example, assuming that the length of the conductive substrate is 340 mm, the region A is the region that lies between the position 42.5 mm distant and the position 68.0 mm distant from the first end toward the center portion and the region B is the region that lies between the position 42.5 mm distant and the position 68.0 mm distant from the second end toward the center portion.

In other words, the regions A and B may be described as regions that are closer to the two ends of the conductive substrate than to the center with respect to the length of the conductive substrate.

The degree of curing is preferably 1.5 or about 1.5 or less and more preferably 1.1 or about 1.1 or less in both the regions A and B of the undercoat layer.

Degree of curing=[Amount (g) of blocking agent separated from blocked isocyanate in undercoat layer]/weight of undercoat layer (g)×100

The amount of the blocking agent separated from the blocked isocyanate in the undercoat layer is measured by the following procedure:

First, the undercoat layer in the regions A and B are completely separated from the conductive substrate and weighed.

Then the separated undercoat layer segments are sealed inside a TG/DTA measurement aluminum cell of a thermo gravimetry analyzer Extra 6300 (produced by Hitachi High-tech Science Corporation) and the temperature is increased from 30° C. to 500° C. at a rate of TG/DTA 10° C./min. The weight reduction (g) that occurs between 30° C. and 230° C. is assumed to be the amount (g) of the blocking agent that separated from the blocked isocyanate in the undercoat layer. The fact that the component whose weight reduction is observed between 30° C. and 230° C. is the blocking agent (for example, methyl ethyl ketone oxime) is confirmed by GC/MS analysis.

The amount of the blocking agent measured as described above is the amount of the blocking agent that has separated from the blocked isocyanate remaining in the undercoat layer. Accordingly, the smaller the amount of the blocking agent in the undercoat layer, the smaller the amount of the blocked isocyanate remaining in the undercoat layer.

Accordingly, in the exemplary embodiment, a degree of curing of 1.5 or about 1.5 or less indicates that the curing reaction of the resin and the blocked isocyanate proceeds sufficiently and the amount of the unreacted blocked isocyanate remaining in the undercoat layer is small.

An electrophotographic photoreceptor of the exemplary embodiment having an undercoat layer with the above-described degree of curing suffers less accumulation of the residual potential in the regions A and B and the decrease in image density determined by the size of dots due to repeated use is suppressed in the regions A and B.

In this exemplary embodiment, the difference in degree of curing between the region A and the region B is preferably small, namely, 0.5 or about 0.5 or less and more preferably 0.3 or about 0.3 or less.

When the difference in degree of curing between the regions A and B is small, in-plane nonuniformity of the image density determined by the size of dots after repeated use is reduced and a high-quality image is obtained.

The above-described degree of curing may be achieved by selecting an appropriate combination of a resin and a blocked isocyanate or by controlling conditions for forming the undercoat layer (drying conditions for coating film: drying method, drying temperature, drying time, etc.), for example.

The degree of curing of the undercoat layer in the exemplary embodiment may be 0.2 or more in order to enhance versatility of the electrophotographic photoreceptor.

The higher the degree of curing, the more suppressed the decrease in image density determined by the size of dots due to repeated use may be. In some cases, the sensitivity may increase simultaneously.

When an electrophotographic photoreceptor has high sensitivity, certain phenomena related to image quality occur depending on the type of the image forming apparatus to which the electrophotographic photoreceptor is applied. For example, excessive toner may adhere to the image, possibly resulting in blurring of fine lines and an increased halftone density, and adhesion of toner onto regions other than where the image is located (fogging) may occur.

Accordingly, from the viewpoint of maintaining the image quality irrespective of types of image forming apparatuses, the electrophotographic photoreceptor may include an undercoat layer having a degree of curing equal to or greater than the lower limit described above.

Other components contained in the undercoat layer in the exemplary embodiment will now be described.

The undercoat layer in the exemplary embodiment may contain, in addition to the cured product of the resin and the blocked isocyanate, metal oxide particles, an electron-accepting substance (acceptor agent), other additives, and the like.

(Metal Oxide Particles)

In the exemplary embodiment, the undercoat layer may contain metal oxide particles. Metal oxide particles form conducting paths in the film of the undercoat layer and facilitate charge transport. As a result, accumulation of charges in the undercoat layer is suppressed and the decrease in image density determined by the size of dots is effectively suppressed.

The metal oxide particles may have a powder resistivity of $10^2$ Ω·cm or more and $10^{11}$ Ω·cm or less.

When the resistivity of the metal oxide particles is equal to or greater than the lower limit of the above-described range, sufficient leak resistance is exhibited. When the resistivity is equal to or lower than the upper limit of the above-described range, the increase in residual potential is efficiently suppressed.

Metal oxide particles of zinc oxide, titanium oxide, tin oxide, aluminum oxide, silicon oxide, zirconium oxide, or the like may be used as the metal oxide particles. In particular, zinc oxide particles may be used as the metal oxide particles.

The metal oxide particles may have a specific surface area of 10 $m^2/g$ or more. At a specific surface area of 10 $m^2/g$ or more, the decrease in chargeability is suppressed and good electrophotographic properties are obtained.

The specific surface area of the metal oxide particles is measured by a single-point BET (gas adsorption) method with a flow-type surface area analyzer, Flowsorb (produced by Shimadzu Corporation).

Two or more types of metal oxide particles that have been subjected to different surface treatments or have different particle diameters, etc., may be mixed and used.

The particle diameter (long axis diameter) of the metal oxide particles is preferably 0.02 μm or more and 1.0 μm or less and more preferably 0.05 μm or more and 0.3 μm or less.

The diameter of the metal oxide particles is measured by microscopic observation using an optical microscope, a scanning electron microscope, a transmission electron microscope, or the like.

The metal oxide particles may be subjected to a surface treatment.

A surface treatment agent is selected from known materials that have desirable properties. Examples of the surface treatment agent include coupling agents such as a silane coupling agent, a zirconium coupling agent, an aluminum coupling agent, and a titanium coupling agent, and surfactants. A silane coupling agent may be used as the surface treatment agent. The silane coupling agent may have an amino group.

The silane coupling agent that has an amino group may be any as long as desirable photoreceptor properties are achieved. Specific examples thereof include, but are not limited to, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane.

Two or more types of silane coupling agents may be mixed and used.

Examples of the silane coupling agent that can be used in combination with the silane coupling agent having an amino group include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

The surface treatment method may be any known method and may be a dry method or a wet method.

According to a dry method, metal oxide particles are surface-treated by adding droplets of a silane coupling agent as is or dissolved in an organic solvent to metal oxide particles being stirred in a mixer that has large shear force or by spraying the silane coupling agent toward the metal oxide particles along with dry air or nitrogen gas. The silane coupling agent may be added or sprayed at a temperature not higher than the boiling point of the solvent. After the silane coupling agent is added or sprayed to the metal oxide particles, baking is performed at 100° C. or higher. Baking may be performed within any range as long as the temperature and time of baking are suitable for obtaining desired electrophotographic properties.

According to a wet method, metal oxide particles are stirred in a solvent and dispersed by using ultrasonic waves, a sand mill, an attritor, a ball mill, or the like, a silane coupling agent solution is added to the mixture, stirred, or dispersed, and then the solvent is removed. The method for removing the solvent may be filtration or distillation. After removal of the solvent, baking is conducted at 100° C. or higher. Baking may be performed within any range as long as the temperature and time of baking are suitable for obtaining desired electrophotographic properties.

In the wet method, water contained in the metal oxide particles may be removed before adding the surface treatment agent. For example, the water may be removed by stirring and heating the metal oxide particles in a solvent used in the surface treatment or may be azeotropically removed with a solvent.

The amount of the silane coupling agent relative to the metal oxide particles in the undercoat layer may be freely set as long as the desirable properties are obtained. For example, the amount of the silane coupling agent is 0.5% by weight or more and 1.25% by weight or less relative to the metal oxide particles.

The content of the metal oxide particles relative to the solid content (weight) in the undercoat layer is preferably in the range of 10% by weight or more and 80% by weight or less and more preferably in the range of 30% by weight or more and 60% by weight or less.

—Electron-Accepting Substance (Acceptor Agent)—

In the exemplary embodiment, when an electron-accepting substance is used in the undercoat layer, the electron-accepting substance attaches to the surfaces of the metal oxide particles and enhances the effect of withdrawing the charges in the layer overlaying the undercoat layer (this layer is hereinafter referred to as an upper layer). Thus, accumulation of residual charges due to repeated use may be further suppressed.

When the undercoat layer contains an electron-accepting substance, exchange of charges at the interface between the undercoat layer and the upper layer is facilitated and accumulation of charges near the interface between the undercoat layer and the upper layer may be effectively suppressed.

The electron-accepting substance may be any compound that achieves the effects of the exemplary embodiment and may be a compound having a group reactive with metal oxide particles, in particular, a hydroxyl group. An electron-accepting compound having an anthraquinone structure having a hydroxyl group is more preferable. Examples of the compound having an anthraquinone structure having a hydroxyl group include hydroxyanthraquinone-based compounds and aminohydroxyanthraquinone-based compounds.

The anthraquinone-based compound (including derivatives) may have a structure represented by general formula (I) below:

[Chem. 1]

(I)

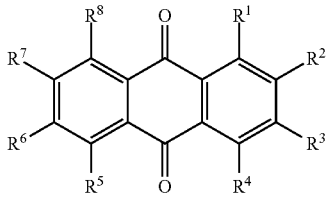

In general formula (I), $R^1$ to $R^8$ each independently represent a hydrogen atom, a halogen atom, a hydroxyl group, an amino group, a substituted or unsubstituted alkyl group, a substituted or unsubstituted alkoxy group, a substituted or unsubstituted aryl group, or a carboxyl group.

Note that for $R^1$ to $R^8$, the number of R representing a hydroxyl group is preferably 2 or 3 and more preferably 2. In particular, $R^1$ preferably represents a hydroxyl group and one of $R^2$ to $R^8$ preferably represents a hydroxyl group.

Specific examples of the anthraquinone-based compounds include an anthraquinone-based compound having two hydroxyl groups (dihydroxyanthraquinone-based compound) such as alizarin, quinizarin, and anthrarufin, an anthraquinone-based compound having three hydroxyl groups (trihydroxyanthraquinone-based compound) such as purpurin (1,2,4-trihydroxyanthraquinone), 1,2,5-trihydroxyanthraquinone, 1,2,7-trihydroxyanthraquinone, 1,2,8-trihydroxyanthraquinone, and 1,3,5-trihydroxyanthraquinone, and the derivatives of the foregoing.

In the exemplary embodiment, the electron-accepting compound content in the undercoat layer may be freely set within the range in which the desired properties are obtained. The electron-accepting compound content relative to the metal oxide particles is preferably in the range of 0.01% by weight or more and 20% by weight or less and more preferably in the range of 0.05% by weight or more and 10% by weight or less.

The ratio of the metal oxide particles to which the electron-accepting substance is attached to the binder resin in a coating solution for forming an undercoat layer is freely set within the range in which the electrophotographic photoreceptor achieves desired properties.

(Other Additives)

The undercoat layer may contain various additives.

Examples of the additive include electron transport substances such as quinone-based compounds, e.g., chloranil and bromanil, tetracyanoquinodimethane-based compounds, fluorenone compounds, e.g., 2,4,7-trinitrofluorenone and 2,4,5,7-tetranitro-9-fluorenone, oxadiazole-based compounds, e.g., 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole, xanthone-based compounds, thiophene compounds, and diphenoquinone compounds, e.g., 3,3',5,5'-tetra-t-butyldiphenoquinone; electron transport pigments, such as fused polycyclic pigments and azo pigments; and zirconium chelate compounds, titanium chelate compounds, aluminum chelate compounds, titanium alkoxide compounds, organic titanium compounds, silane coupling agents, and any other known materials. A silane coupling agent is used in surface-treating zinc oxide but may be further added to the coating solution to serve as an additive.

These compounds may be used alone or a mixture or as a polycondensate of two or more compounds.

(Coating Solvent)

The solvent for preparing the coating solution for forming the undercoat layer is selected from known organic solvents, e.g., alcohol solvents, aromatic solvents, halogenated hydrocarbon solvents, ketone solvents, ketone alcohol solvents, ether solvents, and ester solvents. In particular, a common organic solvent such as methanol, ethanol, n-propanol, isopropanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, or toluene is used.

In this exemplary embodiment, methyl ethyl ketone or the like may be used since it has high volatility and contributes to smooth formation of the undercoat layer.

These organic solvents are used alone or in combination as a mixture. In mixing the solvents, any solvent that dissolves a binder resin can be used as a mixing solvent.

(Method for Preparing Coating Solution)

The coating solution for forming the undercoat layer is prepared by dissolving under stirring or heating if the substances used dissolve in the coating solvent described above.

When a substance, such as metal oxide particles, insoluble in the coating solvent is used, the coating solution is prepared by dispersing. For example, the metal oxide particles may be dispersed by a known method of using, for example, a roll mill, a ball mill, a vibratory ball mill, an attritor, a sand mill, a colloid mill, a paint shaker, or the like.

(Method for Forming Undercoat Layer)

A known method is employed as a coating method used for forming the undercoat layer. Examples of the method include a blade coating method, a wire bar coating method, a spray coating method, a dip coating method, a bead coating method, an air knife coating method, a curtain coating method, a ring coating method, and an ink jet coating method.

A coating film of an undercoat layer is formed on the conductive substrate as such.

Then the coating film of the undercoat layer on the conductive substrate is dried. The conditions for drying are controlled to allow curing reaction between the resin and the blocked isocyanate to proceed and to achieve the degree of curing described above.

In this exemplary embodiment, in order to obtain a film with a uniform thickness and increase the productivity, two or more conductive substrates may be arranged inside the drier so that the conductive substrates stand erect and dried with hot air.

In order to reduce the temperature nonuniformity inside the drier, hot air may be supplied from above and/or below the conductive substrate standing erect. In this exemplary embodiment, since the conductive substrate has a cylindrical shape, hot air enters inside the conductive substrate and accelerates drying of the coating film of the undercoat layer.

In order to achieve the degree of curing described above and separate the blocking agent highly efficiently, the hot air temperature (drying temperature) may be 160° C. or more and 195° C. or less. The time the hot air is supplied (drying time) is preferably 15 to 60 minutes and more preferably 20 to 45 minutes.

The undercoat layer may have a Vickers hardness of 35 or more.

The thickness of the undercoat layer is preferably 15 μm or more and more preferably 20 μm or more from the viewpoint of achieving sufficient leak resistance. The thickness of the undercoat layer is preferably 50 μm or less from the viewpoint of suppressing residual potential during repeated use.

In order to suppress moire images, the surface roughness of the undercoat layer may be adjusted to ¼n (n: refractive index of the upper layer) or more and ½λ or less where λ is the wavelength of the laser used for exposure.

Particles of a resin or the like may be added to the undercoat layer in order to control the surface roughness of the undercoat layer. Examples of the resin particles include silicone resin particles and crosslinked PMMA resin particles.

The undercoat layer may be polished to adjust the surface roughness. Examples of the polishing method include buff polishing, sand blasting, wet honing, and grinding.

(Intermediate Layer)

Although not illustrated in the drawings, an interlayer may be disposed between the undercoat layer and the photosensitive layer.

The intermediate layer is, for example, a layer that contains a resin. Examples of the resin used in the intermediate layer include polymeric compounds such as acetal resins (for example, polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer that contains an organic metal compound. Examples of the organic metal compound used in the intermediate layer include those that contain metal atoms of zirconium, titanium, aluminum, manganese, silicon, etc.

These compounds used in the intermediate layer may be used alone or as a mixture or a polycondensate of two or more compounds.

In particular, the intermediate layer may be a layer that contains an organic metal compound that contains a zirconium atom or a silicon atom.

The intermediate layer may be formed by any known method. For example, a coating film may be formed by using a coating solution for forming an intermediate layer, the coating solution containing the above-described components and a solvent, and then drying and, optionally, heating the coating film.

The coating method used for forming the intermediate layer may be a known method such as a dip coating method, a lift coating method, a wire bar coating method, a spray coating method, a blade coating method, a knife coating method, or a curtain coating method.

The thickness of the intermediate layer may be set to be in the range of 0.1 μm or more and 3 μm or less.

(Charge Generation Layer)

The charge generation layer is, for example, a layer that contains a charge generation material and a binder resin. The charge generation layer may be a vapor-deposited layer of a charge generation material. The vapor-deposited layer of a charge generation material is suitable when an incoherent light source such as a light-emitting diode (LED) or an organic electro luminescence (EL) image array is used.

Examples of the charge generation material include azo pigments such as bisazo and trisazo pigments, fused aromatic pigments such as dibromoanthanthrone, perylene pigments, pyrrolopyrrole pigments, phthalocyanine pigments, zinc oxide, and trigonal system selenium.

Among these, a metal phthalocyanine pigment or a metal-free phthalocyanine pigment may be used as a charge generation material in order to be compatible with near-infrared laser exposure. Specific examples of the pigment include hydroxygallium phthalocyanine disclosed in Japanese Unexamined Patent Application Publication Nos. 5-263007 and 5-279591 etc., chlorogallium phthalocyanine disclosed in Japanese Unexamined Patent Application Publication No. 5-98181 etc., dichlorotin phthalocyanine disclosed in Japanese Unexamined Patent Application Publication Nos. 5-140472 and 5-140473, etc., and titanyl phthalocyanine disclosed in Japanese Unexamined Patent Application Publication No. 4-189873, etc.

Examples of the charge generation material compatible with near-ultraviolet laser exposure include fused aromatic pigments such as dibromoanthanthrone, thioindigo pigments, porphyrazine compounds, zinc oxide, trigonal-system selenium, and bisazo pigments disclosed in Japanese Unexamined Patent Application Publication Nos. 2004-78147 and 2005-181992.

The above-described charge generation materials may be used when an incoherent light source such as an organic EL image array or an LED having a center wavelength within the range of 450 nm to 780 nm is used. However, when the photosensitive layer is designed as a thin film having a thickness of 20 μm or less from the viewpoint of resolution, the field strength in the photosensitive layer increases and electrification resulting from charge injection from the conductive substrate decreases, thereby readily generating image defects known as black spots. This phenomenon is notable when a charge generation material, such as trigonal system selenium or a phthalocyanine pigment, that is a p-type semiconductor and readily generates dark current is used.

In contrast, when an n-type semiconductor such as a fused aromatic pigment, a perylene pigment, or an azo pigment is used as the charge generation material, dark current rarely occurs and image defects called black spots are suppressed even if the photoconductive layer is thin. Examples of the n-type charge generation material include, but are not limited to, compounds (CG-1) to (CG-27) described in paragraphs [0288] to [0291] of Japanese Unexamined Patent Application Publication No. 2012-155282.

Whether the material is of an n-type is determined by the polarity of the photocurrent observed in a common time-of-flight method and the material in which electrons rather than holes easily flow is identified as the n-type.

The binder resin used in the charge generation layer is selected from a wide variety of insulating resins. The binder resin may be selected from organic photoconductive polymers such as poly-N-vinylcarbazole, polyvinylanthracene, polyvinylpyrene, and polysilane.

Examples of the binder resin include polyvinyl butyral resins, polyarylate resins (polycondensate of a bisphenol and an aromatic dicarboxylic acid, for example), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. Herein the "insulating" means that the volume resistivity is $10^{13}$ Ω·cm or more.

These binder resins may be used alone or in combination as a mixture.

The blend ratio of the charge generation material to the binder resin in terms of weight ratio may be within the range of 10:1 to 1:10.

The charge generation layer may contain other known additives.

The charge generation layer may be formed by any known method. For example, a coating film may be formed by using a coating solution for forming a charge generation layer, the coating solution containing the above-described components and a solvent, and then dried and, optionally heated. The charge generation layer may be formed by vapor deposition of a charge generation material. Forming a charge generation layer by vapor deposition is suitable when a fused aromatic pigment or a perylene pigment is used as the charge generation material.

Examples of the solvent used for preparing the coating solution for forming a charge generation layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents may be used alone or in combination as a mixture.

In order to disperse particles (for example, the charge generation material) in the coating solution for forming a charge generation layer, a media disperser such as a ball mill, a vibratory ball mill, an attritor, a sand mill, or a horizontal sand mill or a medialess disperser such as a stirrer, an ultrasonic disperser, a roll mill, or a high-pressure homogenizer is used. Examples of the high-pressure homogenizer include a collision-type homogenizer in which dispersing is performed by subjecting the dispersion to liquid-liquid collision or liquidwall collision in a high-pressure state and a penetration-type homogenizer in which dispersing is performed by causing the dispersion to penetrate small channels in a high pressure state.

During dispersing, it is effective to adjust the average particle diameter of the charge generation material in the coating solution for forming a charge generation layer to 0.5 μm or less, preferably 0.3 μm or less, and more preferably 0.15 μm or less.

Examples of the method for coating the undercoat layer (or intermediate layer) with the coating solution for forming a charge generation layer include common methods such as a blade coating method, a wire bar coating method, a spray coating method, a dip coating method, a bead coating method, an air knife coating method, and a curtain coating method.

The thickness of the charge generation layer is, for example set within the range of preferably 0.1 μm or more and 5.0 μm or less and more preferably 0.2 μm or more and 2.0 μm or less.

(Charge Transport Layer)

The charge transport layer is, for example, a layer that contains a charge transport material and a binder resin. The charge transport layer may be a layer that contains a polymeric charge transport material.

Examples of the charge transport material include electron transport compounds such as quinone compounds, e.g., p-benzoquinone, chloranil, bromanil, and anthraquinone, tetracyanoquinodimethane compounds, fluorenone compounds, e.g., 2,4,7-trinitrofluorenone, xanthone compounds, benzophenone compounds, cyanovinyl compounds, and ethylene compounds. Other examples of the charge transport material include hole transport compounds such as triarylamine compounds, benzidine compounds, aryl alkane compounds, aryl-substituted ethylene compounds, stilbene compounds, anthracene compounds, and hydrazone compounds. These charge transport materials may be used alone or in combination. The examples of the charge transport materials are not limited to those described above.

The charge transport material may be a triarylamine derivative represented by structural formula (a-1) below or a benzidine derivative represented by structural formula (a-2) below from the viewpoint of charge mobility.

[Chem. 2]

(a-1)

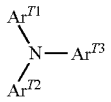

In the structural formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$; and $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituent in the groups described above include a halogen atom, an alkyl group having 1 to 5 carbon atoms, and an alkoxy group having 1 to 5 carbon atoms. Another example of the substituent is a substituted amino group substituted with an alkyl group having 1 to 3 carbon atoms.

[Chem. 3]

(a-2)

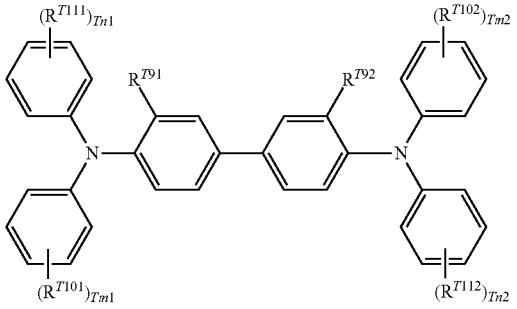

In structural formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms. $R^{T101}$, $R^{T102}$, $R^{T111}$, and $R^{T112}$ each independently represent a halogen atom, an alkyl group having 1 to 5 carbon atoms, an alkoxy group having 1 to 5 carbon atoms, and an amino group substituted with an alkyl group having 1 or 2 carbon atoms, a substituted or unsubstituted aryl group, $—C(R^{T12})=C(R^{T13})(R^{T14})$, or $—CH=CH—CH=C(R^{T15})(R^{T16})$ and $R^{T12}$, $R^{T13}$, $R^{T14}$, $R^{T15}$, and $R^{T16}$ each independently represent a hydrogen atom, a substituted or unsubstituted alkyl group, or a substituted or unsubstituted aryl group. Tm1, Tm2, Tn1, and Tn2 each independently represent an integer of 0 or more and 2 or less.

Examples of the substituent in the groups described above include a halogen atom, an alkyl group having 1 to 5 carbon atoms, and an alkoxy group having 1 to 5 carbon atoms. Another example of the substituent is a substituted amino group substituted with an alkyl group having 1 to 3 carbon atoms.

Among the triarylamine derivative represented by structural formula (a-1) and the benzidine derivative represented by structural formula (a-2), a triarylamine derivative having $—C_6H_4—CH=CH—CH=C(R^{T7})(R^{T8})$ and a benzidine derivative having $—CH=CH—CH=C(R^{T15})(R^{T16})$ are preferable from the viewpoint of the charge mobility.

A known compound having a charge transport property, such as poly-N-vinylcarbazole or polysilane, is used as the polymeric charge transport material. In particular, polyester-based polymeric charge transport materials disclosed in Japanese Unexamined Patent Application Publication Nos. 8-176293 and 8-208820 etc., may be used as the polymeric charge transport material. These polymeric charge transport materials may be used alone or in combination with a binder resin.

Examples of the binder resin used in the charge transport layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. Among these, a polycarbonate resin or a polyarylate resin is suitable as the binder resin. These resins may be used alone or in combination.

The blend ratio of the charge transport material to the binder resin in terms of weight ratio may be 10:1 to 1:5.

The charge transport layer may contain other known additives.

The charge transport layer may be formed by any known method. For example, a coating film is formed by using a coating solution for forming a charge transport layer, the coating solution containing the above-described components and a solvent, and dried and optionally heated to form the charge transport layer.

Examples of the solvent for preparing the coating solution for forming a charge transport layer are common organic solvents. Examples thereof include aromatic hydrocarbons such as benzene, toluene, xylene, and chlorobenzene, ketones such as acetone and 2-butanone, halogenated aliphatic hydrocarbons such as methylene chloride, chloroform, and ethylene chloride, and cyclic or linear ethers such as tetrahydrofuran and ethyl ether. These solvents may be used alone or in combination as a mixture.

Examples of the coating method employed to coat the charge generation layer with the coating solution for forming a charge transport layer include common methods such as a blade coating method, a wire bar coating method, a spray coating method, a dip coating method, a bead coating method, an air knife coating method, and a curtain coating method.

The thickness of the charge transport layer is, for example, set to be in the range of preferably 5 μm or more and 50 μm or less and more preferably 10 μm or more and 30 μm or less.

(Protective Layer)

The protective layer is disposed on the photosensitive layer if needed. The protective layer is formed to prevent chemical changes of the photosensitive layer during charging and further improve the mechanical strength of the photosensitive layer.

Accordingly, the protective layer may be a layer formed of a cured film (crosslinked film). Examples of this layer are layers described in 1) and 2) below:

1) A layer formed of a cured film prepared from a composition containing a reactive group-containing charge transport material that has a reactive group and a charge transport skeleton in the same molecule (namely, a layer that contains a polymer or a crosslinked product of the reactive group-containing charge transport material)

2) A layer formed of a cured film prepared from a composition containing an unreactive charge transport material and a reactive group-containing non-charge transport material that has no charge transport skeleton but has a reactive group (namely, a layer that contains a polymer or a crosslinked product of an unreactive charge transport material and a reactive group-containing non-charge transport material).

The reactive group of the reactive group-containing charge transport material may be any of known reactive groups. Examples of the reactive groups include a chain-polymerizable group, an epoxy group, —OH, —OR [where R represents an alkyl group], —$NH_2$, —SH, —COOH, and —$SiR^{Q1}_{3-Qn}(OR^{Q2})_{Qn}$ [where $R^{Q1}$ represents a hydrogen atom, an alkyl group, or a substituted or unsubstituted aryl group, $R^{Q2}$ represents a hydrogen atom, an alkyl group, or a trialkylsilyl group, and Qn represents an integer of 1 to 3.].

The chain-polymerizable group may be any radical-polymerizable functional group. For example, the chain-polymerizable group is a functional group that includes at least a carbon-carbon double bond. The chain-polymerizable group may be a group that contains at least one selected from the group consisting of a vinyl group, a vinyl ether group, a vinyl thioether group, a styryl group, an acryloyl group, a methacryloyl group, and derivatives of the foregoing. In particular, a group that contains at least one selected from the group consisting of a vinyl group, a styryl group, an acryloyl group, a methacryloyl group, and derivatives of the foregoing is preferable as the chain-polymerizable group due to its high reactivity.

The charge transport skeleton of the reactive group-containing charge transport material may be any known structure for electrophotographic photoreceptors. Examples thereof include skeletons derived from nitrogen-containing hole transport compounds such as triarylamine compounds, benzidine compounds, and hydrazone compounds, the skeleton being conjugated with a nitrogen atom. Among these, a triarylamine skeleton is preferable.

The reactive group-containing charge transport material having a reactive group and a charge transport skeleton, the unreactive charge transport material, and the reactive group-containing non-charge transport material may be selected from known materials.

The protective layer may contain known additives in addition.

The protective layer may be formed by any known method. For example, a coating film is formed by using a coating solution for forming a protective layer, the coating solution containing the above-described components and a solvent, and then dried and optionally heated to perform curing.

Examples of the solvent used for preparing the coating solution for forming a protective layer include aromatic solvents such as toluene and xylene, ketone solvents such as methyl ethyl ketone, methyl isobutyl ketone, and cyclohexanone, ester solvents such as ethyl acetate and butyl acetate, ether solvents such as tetrahydrofuran and dioxane, cellosolve solvents such as ethylene glycol monomethyl ether, and alcohol solvents such as isopropyl alcohol and butanol. These solvents may be used alone or in combination as a mixture.

The coating solution for forming a protective layer may be a solvent-free coating solution.

The coating method used for coating the photosensitive layer (for example, the charge transport layer) with the coating solution for forming a protective layer may be a known method such as a dip coating method, a lift coating method, a wire bar coating method, a spray coating method, a blade coating method, a knife coating method, or a curtain coating method.

The thickness of the protective layer is set within the range of preferably 1 μm or more and 20 μm or less and more preferably 2 μm or more and 10 μm or less.

[Image Forming Apparatus (and Process Cartridge)]

An image forming apparatus according to an exemplary embodiment includes an electrophotographic photoreceptor, a charging unit configured to charge a surface of the electrophotographic photoreceptor, an electrostatic latent image forming unit configured to form an electrostatic latent image on the charged surface of the electrophotographic photoreceptor, a development unit configured to develop the electrostatic latent image on the surface of the electrophotographic photoreceptor by using a developer containing a toner so as to form a toner image, and a transfer unit configured to transfer the toner image onto a surface of a recording medium. The aforementioned electrophotographic photoreceptor of the exemplary embodiment is used as the electrophotographic photoreceptor.

The image forming apparatus of the exemplary embodiment is applied to a known image forming apparatus such as an apparatus that includes a fixing unit configured to fix a toner image transferred onto a surface of a recording medium, a direct transfer-type apparatus configured to directly transfer a toner image on a surface of an electrophotographic photoreceptor onto a recording medium, an intermediate transfer-type apparatus configured to transfer a toner image on a surface of a photoreceptor onto a surface of an intermediate transfer body (primary transfer) and then transfer the toner image on the intermediate transfer body onto a surface of a recording medium (secondary transfer), an apparatus including a cleaning unit configured to clean a surface of an electrophotographic photoreceptor before charging and after the transfer of a toner image, an apparatus that includes a charge erasing unit configured to irradiate a surface of an electrophotographic photoreceptor with charge erasing light after the transfer of a toner image and before charging so as to erase charges, and an apparatus that includes an electrophotographic photoreceptor-heating member configured to increase the temperature of an electrophotographic photoreceptor and decrease the relative temperature.

In the case of the intermediate transfer-type apparatus, the transfer unit includes, for example, an intermediate transfer body having a surface onto which a toner image is transferred, a primary transfer unit configured to transfer the toner image on the surface of the electrophotographic photoreceptor onto a surface of the intermediate transfer body (primary transfer), and a secondary transfer unit configured to transfer the toner image on the surface of the intermediate transfer body onto a surface of a recording medium.

The image forming apparatus according to the exemplary embodiment may be of a dry development type or a wet development type (development is conducted with a liquid developer).

In the image forming apparatus according to the exemplary embodiment, for example, the section where the electrophotographic photoreceptor is placed may have a cartridge structure (process cartridge) detachably attachable to the image forming apparatus. A process cartridge that includes the photoreceptor according to the exemplary embodiment may be used as the process cartridge. The process cartridge may further include, in addition to the electrophotographic photoreceptor, at least one unit selected from a charging unit, an electrostatic latent image forming unit, a development unit, and a transfer unit.

One example of an image forming apparatus according to the exemplary embodiment is described below. This example is not limiting. Only the parts illustrated in the drawings are described and description of the rest is omitted.

Figure 2:
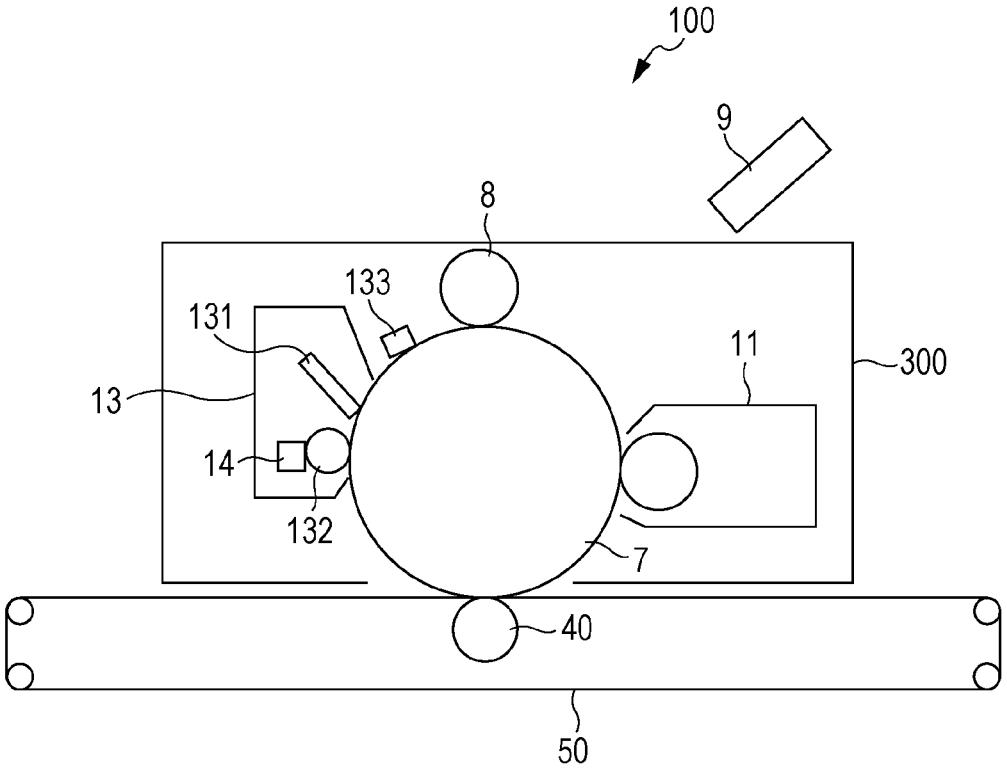
FIG. 2 is a schematic view of an example of an image forming apparatus according to an exemplary embodiment.

FIG. 2 is a schematic diagram of an example of the image forming apparatus according to the exemplary embodiment.

Referring to FIG. 2, an image forming apparatus 100 of the exemplary embodiment includes a process cartridge 300 that includes an electrophotographic photoreceptor 7, an exposure device 9 (one example of the electrostatic latent image forming unit), a transfer device 40 (primary transfer device), and an intermediate transfer body 50. In the image forming apparatus 100, the exposure device 9 is located at a position capable of exposing the electrophotographic photoreceptor 7 through an opening of the process cartridge 300. The transfer device 40 is located at a position facing the electrophotographic photoreceptor 7 with the intermediate transfer body 50 therebetween. The intermediate transfer body 50 has a portion in contact with the electrophotographic photoreceptor 7. Although not illustrated in the drawing, the image forming apparatus 100 also includes a secondary transfer device configured to transfer the toner image on the intermediate transfer body 50 onto a recording medium (for example, a paper sheet). The intermediate transfer body 50, the transfer device 40 (primary transfer device), and the secondary transfer device (not illustrated) constitute an example of the transfer unit.

The process cartridge 300 in FIG. 2 integrally supports, inside a housing, the electrophotographic photoreceptor 7, a charging device 8 (an example of the charging unit), a development device 11 (an example of development unit), and a cleaning device 13 (an example of a cleaning unit). The cleaning device 13 includes a cleaning blade (an example of the cleaning member) 131. The cleaning blade 131 is arranged to come into contact with a surface of the electrophotographic photoreceptor 7. The cleaning member may be a conductive or insulating fibrous member instead of the cleaning blade 131 and the conductive or insulating fibrous member may be used alone or in combination with the cleaning blade 131.

In the image forming apparatus illustrated in FIG. 2, a fibrous member 132 (having a roll shape) configured to supply a lubricant 14 to the surface of the electrophotographic photoreceptor 7 and a fibrous member 133 (having a shape of a flat brush) configured to assist cleaning are provided. These components are optional.

The structures of the image forming apparatus according to this exemplary embodiment are as follows.

—Charging Device—

Examples of the charging device 8 include contact-type chargers such as a conductive or semiconductive charge roller, a charge brush, a charge film, a charge rubber blade, and a charge tube. Alternatively, other known chargers such as a non-contact-type roller charger, a scorotron charger or corotron charger that utilizes corona discharge, etc., may also be used.

—Exposure Device—

Examples of the exposure device 9 include optical devices configured to expose the surface of the electrophotographic photoreceptor 7 to form a particular image with light such as semiconductor laser light, LED light, or a liquid crystal shutter light. The wavelength of the light source is to be within the spectral sensitivity region of the photoreceptor. The mainstream wavelength of the semiconductor laser is near-infrared having an oscillation wavelength at about 780 nm. However, the wavelength is not limited to this and a laser having an oscillation wavelength at about 600 nm and a blue laser having an oscillation wavelength in the range of 400 nm or more and 450 nm or less may be used. A surface-emitting laser light source capable of outputting multi beams is effective in forming color images.

—Development Device—

Examples of the development device 11 include common development devices that perform developing by using a developer in a contact or non-contact manner. The development device 11 may be any development device that performs this function and may be selected according to the purpose. An example of the development device is a known development device configured to cause a mono-component developer or two-component developer to attach to the electrophotographic photoreceptor 7 by using a brush, a roller, or the like. In particular, the development device may use a development roller that supports the developer on the surface thereof.

The developer used in the development device 11 may be a mono-component developer solely configured by a toner or a two-component developer that contains a toner and a carrier. The developer may be magnetic or nonmagnetic. A known developer may be used.

—Cleaning Device—

A cleaning blade-type device equipped with a cleaning blade 131 is used as the cleaning device 13.

Instead of the cleaning blade-type device, a fur brush cleaning-type device may be employed or cleaning may be conducted simultaneously with development.

—Transfer Device—

The transfer device 40 may be a known transfer charger. Examples thereof include contact-type transfer chargers such as chargers that use a belt, a roller, a film, a rubber blade, or the like, and scorotron transfer chargers and corotron chargers that utilize corona discharge.

—Intermediate Transfer Body—

A belt-shaped intermediate transfer body (intermediate transfer belt) formed of a semiconductive polyimide, polyamide imide, polycarbonate, polyarylate, polyester, rubber, or the like is used as the intermediate transfer body 50. The intermediate transfer body may have a drum shape instead of the belt shape.

Figure 3:
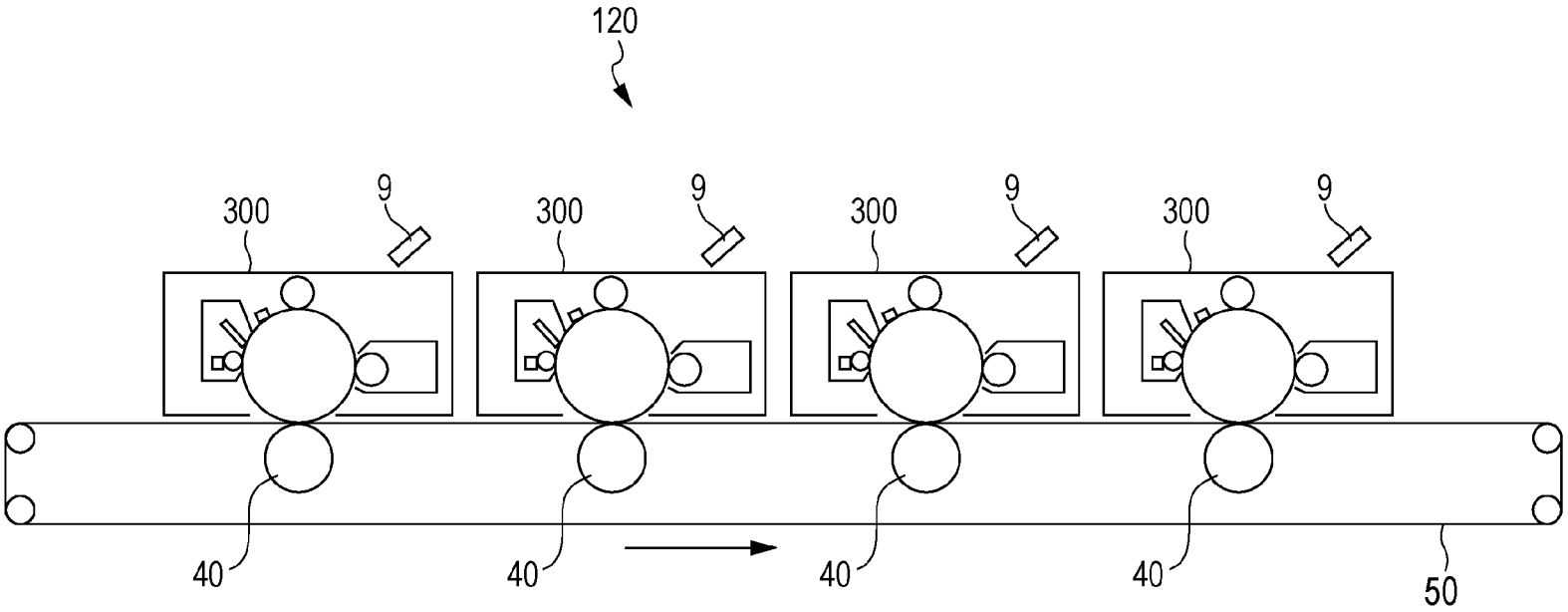
FIG. 3 is a schematic view of another example of an image forming apparatus according to an exemplary embodiment.

FIG. 3 is a schematic diagram illustrating another example of the image forming apparatus according to the exemplary embodiment.

An image forming apparatus 120 illustrated in FIG. 3 is a tandem-type multicolor image forming apparatus equipped with four process cartridges 300. In the image forming apparatus 120, four process cartridges 300 are arranged side by side on the intermediate transfer body 50. One electrophotographic photoreceptor is used for one color. The image forming apparatus 120 has the same structure as the image forming apparatus 100 except that it is of a tandem type.

EXAMPLES

The exemplary embodiments will now be described in further detail by using Examples and Comparative Examples which do not limit the scope of the invention. In the description below, "part" means "part by weight" unless otherwise noted.

Example 1

Formation of Undercoat Layer

A cut aluminum pipe having a diameter of 30 mm, a length of 340 mm, and a thickness of 1.0 mm is prepared as a conductive substrate.

Next, 100 parts by weight of zinc oxide (average particle diameter: 70 nm, produced by Tayca Corporation, specific surface area: 15 $m^2/g$) and 500 parts by weight of toluene are stirred and mixed. Thereto, 0.75 part by weight of a silane coupling agent (KBM603 produced by Shin-Etsu Chemical Co., Ltd.) is added, followed by stirring for 2 hours. Then toluene is distilled away at a reduced pressure, baking is performed at 120° C. for 3 hours, and a zinc oxide pigment surface-treated with a silane coupling agent is obtained as a result.

Next, 25 parts by weight of methyl ethyl ketone and 38 parts by weight of a solution prepared by dissolving 60 parts by weight of the surface-treated zinc oxide pigment, 0.6 part by weight of alizarin, 13.5 parts by weight of a curing agent (blocked isocyanate Sumidur BL 3175 (produced by Sumitomo Bayer Urethane Co., Ltd.) and 15 parts by weight of a butyral resin (S-LEC BM-1 produced by Sekisui Chemical Co., Ltd.) in 85 parts by weight of methyl ethyl ketone are mixed and the resulting mixture is dispersed for 2 hours in a sand mill with 1 mm glass beads. As a result, a dispersion is obtained.

To the dispersion, 0.005 part by weight of dioctyltin dilaurate serving as a catalyst and 4.0 parts by weight of silicone resin particles (TOSPEARL 145 produced by GE Toshiba Silicones) are added to prepare a coating solution for forming an undercoat layer.

The coating solution for forming an undercoat layer is applied to the cut aluminum pipe by a dip coating method and cured by drying at 180° C. (temperature inside the drying oven) for 20 minutes. As a result, an undercoat layer having a thickness of 20 μm is obtained.

The undercoat layer is dried by arranging the cut aluminum pipe coated with the coating solution for forming an undercoat layer to stand erect on a metal palette inside the drying oven and blowing hot air from above (hot air drying). During drying, the region A is located on the upper side of the cut aluminum pipe and the region B is located on the lower side of the cut aluminum pipe.

(Formation of Charge Generation Layer)

Next, a mixture containing 15 parts of hydroxygallium phthalocyanine serving as a charge generation material, 10 parts of vinyl chloride-vinyl acetate copolymer resin (VMCH produced by Dow Chemical Company) serving as a binder resin, and 200 parts by n-butyl acetate are dispersed for 4 hours in a sand mill with glass beads 1 mm in diameter. The hydroxygallium phthalocyanine had diffraction peaks at least at Bragg's angles (2θ±0.2°) of 7.3°, 16.0°, 24.9°, and 28.0° in an X-ray diffraction spectrum measured with a Cuk α line.

To the resulting dispersion, 175 parts of n-butyl acetate and 180 parts of methyl isobutyl ketone are added and the mixture is stirred to obtain a coating solution for forming a charge generation layer.

The coating solution for forming a charge generation layer is applied to the undercoat layer by dip-coating and dried at room temperature. As a result, a charge generation layer having a thickness of 0.2 μm is obtained.

(Formation of Charge Transport Layer)

Next, to a solution prepared by dissolving 0.06 part by weight of fluorine-based graft polymer GF400 (produced by Toagosei Co., Ltd.) in 4.3 parts by weight of toluene, 1.8 parts by weight of poly tetrafluoride ethylene resin particles (average particle diameter: 0.2 μm) is added. The resulting mixture is stirred and mixed for 48 hours while keeping the solution temperature to 20° C. As a result, an poly tetrafluoride ethylene resin particle suspension (solution A) is obtained.

Next, a mixture of 9.8 parts by weight of N,N'-bis(3-methylphenyl)-N,N'-diphenylbenzidine and 13.0 parts by weight of a bisphenol Z-type polycarbonate resin (viscosity-average molecular weight: 40,000) serving as charge transport substances, and 0.2 part by weight of 2,6-di-t-butyl-4-methylphenol are mixed and dissolved in 48.3 parts by weight of tetrahydrofuran and 18.2 parts by weight of toluene. As a result, a solution B is obtained.

The solution A is added to the solution B, followed by mixing and stirring. Then the mixture is processed with a high-pressure homogenizer (Yoshida Kikai Co., Ltd.) equipped with a penetration-type chamber having small channels by increasing the pressure up to 500 $kgf/cm^2$. The dispersion process is conducted 6 times. To the resulting mixture, 5 ppm of silicone oil (trade name: KP340 produced by Shin-Etsu Chemical Co., Ltd.) is added. The resulting mixture is thoroughly stirred to obtain a coating solution for forming a charge transport layer.

The coating solution for forming a charge transport layer is applied to the charge generation layer and dried at 115° C. for 40 minutes. As a result, a charge transport layer having a thickness of 30 μm is obtained.

A photoreceptor E1 is produced through the above-described steps.

The degree of curing of the undercoat layer of the photoreceptor E1 is measured in the region A and the region B by the method described above. The results are indicated in Table.

Example 2

Formation of Undercoat Layer

A cut aluminum pipe having a diameter of 40 mm, a length of 357 mm, and a thickness of 2.0 mm is prepared as a conductive substrate.

Then 100 parts by weight of zinc oxide (average particle diameter: 70 nm, produced by Tayca Corporation, specific surface area: 15 $m^2/g$) are mixed with 500 parts by weight of toluene and stirred, 1.00 parts by weight of a silane coupling agent (KBM603 produced by Shin-Etsu Chemical Co., Ltd.) is added thereto, and the resulting mixture is stirred for 2 hours. Toluene is then distilled away at a reduced pressure and baking is performed at 120° C. for 3 hours. As a result, a zinc oxide pigment surface-treated with a silane coupling agent is obtained.

Next, 25 parts by weight of methyl ethyl ketone and 38 parts by weight of a solution prepared by dissolving 60 parts by weight of the surface-treated zinc oxide pigment, 2.5 parts by weight of 4-ethoxy-1,2-dihydroxyanthraquinone, 13.5 parts by weight of a curing agent (blocked isocyanate, Sumidur BL3175 (produced by Sumitomo Bayer Urethane Co., Ltd.)) and 15 parts by weight of a butyral resin (S-LEC BM-1 produced by Sekisui Chemical Co., Ltd.) in 85 parts by weight of methyl ethyl ketone are mixed. The resulting mixture is dispersed for 2 hours in a sand mill with glass beads 1 mm in diameter. As a result, a dispersion is obtained.

To the dispersion, 0.005 part by weight of dioctyltin dilaurate serving as a catalyst and 3.5 parts by weight of silicone resin particles, TOSPEARL 145 produced by GE Toshiba Silicones, are added to prepare a coating solution for forming an undercoat layer. The coating solution for forming an undercoat layer is applied to the cut aluminum pipe by a dip coating method and cured by drying at 180° C. (temperature inside the drying oven) for 25 minutes. As a result, an undercoat layer having a thickness of 25 μm is obtained.

The undercoat layer is dried by arranging the cut aluminum pipe coated with the coating solution for forming an undercoat layer to stand erect on a metal palette inside the drying oven and blowing hot air from above (hot air drying). During drying, the region A is located on the upper side of the cut aluminum pipe and the region B is located on the lower side of the cut aluminum pipe.

(Formation of Charge Generation Layer and Charge Transport Layer)

A charge generation layer and a charge transport layer are formed on the undercoat layer as in Example 1. As a result, a photoreceptor E2 is obtained.

The degree of curing of the undercoat layer of the photoreceptor E2 is measured in the region A and the region B by the method described above. The results are indicated in Table.

Example 3

A photoreceptor E3 is obtained by forming an undercoat layer, a charge generation layer, and a charge transport layer as in Example 1 except that, in forming the undercoat layer, the drying conditions are changed to 190° C. (temperature inside the drying oven) and 40 minutes and that the cut aluminum pipe coated with the coating solution for forming an undercoat layer is hanged in the drying oven and hot-air drying is performed by blowing hot air from above a hanger.

The degree of curing of the undercoat layer of the photoreceptor E3 is measured in the region A and the region B by the method described above. The results are indicated in Table.

Comparative Example 1

A photoreceptor C1 is obtained by forming an undercoat layer, a charge generation layer, and a charge transport layer as in Example 1 except that, in forming the undercoat layer, the drying conditions are changed to 150° C. (temperature inside the drying oven) and 30 minutes.

The degree of curing of the undercoat layer of the photoreceptor C1 is measured in the region A and the region B by the method described above. The results are indicated in Table.

Comparative Example 2

A photoreceptor C2 is obtained by forming an undercoat layer, a charge generation layer, and a charge transport layer as in Example 1 except that, in forming the undercoat layer, the drying conditions are changed to 160° C. (temperature inside the drying oven) and 15 minutes.

The degree of curing of the undercoat layer of the photoreceptor C2 is measured in the region A and the region B by the method described above. The results are indicated in Table.

Comparative Example 3

A photoreceptor C3 is obtained by forming an undercoat layer, a charge generation layer, and a charge transport layer as in Example 1 except that, in forming the undercoat layer, the drying conditions are changed to 150° C. (temperature inside the drying oven) and 30 minutes and that the cut aluminum pipe coated with the coating solution for forming an undercoat layer is hanged in the drying oven and hot-air drying is performed by blowing hot air from above a hanger.

The degree of curing of the undercoat layer of the photoreceptor C3 is measured in the region A and the region B by the method described above. The results are indicated in Table.

Evaluation

Evaluation Using Actual Apparatus

Each of the photoreceptors obtained in the examples and comparative examples is attached to a drum cartridge. A modified model of a full-color printer DocuCentre Color f450 produced by Fuji Xerox Co., Ltd., is used to measure the residual potential of the photoreceptor in a 28° C./85% RH environment.

A full halftone image with 20% image density determined by the number of dots per unit area is formed and then a full halftone image with 60% image density determined by the number of dots per unit area is continuously printed out on 200,000 sheets (200,000-sheet continuous printing test).

Then the increase in residual potential of the photoreceptor and the decrease in image density determined by the size of dots are evaluated.

—Increase in Residual Potential of Photoreceptor—

After the 200,000-sheet continuous printing test, the surface potential (X) in the regions corresponding to the region A and the region B of the photoreceptor is measured and compared with the initial surface potential (Y) of the photoreceptor.

The increase [(X)−(Y)] in residual potential in the regions corresponding to the region A and the region B determined by the comparison is indicated in Table.

A surface electrometer (Model 334 produced by TREK INC.) is used for measuring the surface potential.

—Decrease in Image Density Determined by the Size of Dots—

After 200,000-sheet continuous printing test, a full halftone image with 20% image density determined by the number of dots per unit area is printed out by using the modified model described above. The image density (x) of the regions of this halftone image corresponding to the region A and the region B is measured.

The image density (x) is compared with the image density (y) of the regions of the halftone image corresponding to the region A and the region B before the 200,000-sheet continuous printing test.

The decrease rate [(x)/(y)×100] in image density in the regions corresponding to the region A and the region B determined by the comparison is indicated in Table.

TABLE

| | Photoreceptor | | | Evaluation results | | | |
|---|---|---|---|---|---|---|---|
| | | Degree of curing | | Increase in residual potential | | Decrease rate in image density determined by the size of dots | |
| | No. | Region A | Region B | Region A | Region B | Region A | Region B |
| Example 1 | E1 | 0.60 | 0.80 | 10 V | 20 V | 90% | 90% |
| Example 2 | E2 | 0.85 | 0.91 | 15 V | 25 V | 90% | 90% |
| Example 3 | E3 | 0.10 | 0.10 | 5 V | 5 V | 98% | 98% |
| Comparative Example 1 | C1 | 1.68 | 1.75 | 200 V | 250 V | 40% | 40% |
| Comparative Example 2 | C2 | 1.55 | 1.65 | 190 V | 200 V | 80% | 75% |
| Comparative Example 3 | C3 | 1.80 | 1.55 | 280 V | 190 V | 30% | 75% |

The results indicate that compared to Comparative Examples, the increase in residual potential is suppressed and the decrease rate in image density determined by the size of dots due to repeated use is less in Examples.

Experimental Example

Two photoreceptors E3 of Example 3 are prepared. Each is subjected to a 200,000-sheet continuous printing test described in the evaluation using the actual apparatus described above. Then the photoreceptors are respectively attached to a modified model of a full-color printer DocuCentre Color f450 produced by Fuji Xerox Co., Ltd., and a modified model of a full-color printer DocuCentre Color 2263 produced by Fuji Xerox Co., Ltd.

Then a blank-page printing test is performed in each of the modified printers.

As a result, fogging occurs in the modified model of DocuCentre Color f450 but fogging did not occur in the modified model of DocuCentre Color 2263.

This indicates that when the degree of curing of the photoreceptor is low (for example, less than 0.2), the decrease rate in image density determined by the size of dots after repeated use may be excellent but fogging may occur depending on the type of the printer used or the conditions of use. Thus, such a photoreceptor may be inferior in terms versatility.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a cylindrical conductive substrate;

an undercoat layer containing a cured product of a resin and a blocked isocyanate and having a degree of curing of about 1.5 or less in both a region A and a region B defined below, the degree of curing being determined from an equation below; and a photosensitive layer, wherein the undercoat layer is disposed on the cylindrical conductive substrate and the photosensitive layer is disposed on the undercoat layer, and the undercoat layer further contains an electron-accepting substance, Region A: A region that lies between a position distant from a first end of the conductive substrate by about ⅛ of a length of the conductive substrate toward a center portion in an axis direction and a position distant from the first end of the conductive substrate by ⅕ or about ⅕ of the length of the conductive substrate toward the center portion in the axis direction Region B: A region that lies between a position distant from a second end of the, conductive substrate by ⅛ or about ⅛ of the length of the conductive substrate toward the center portion in the axis direction and a position distant from the second end of the conductive substrate by ⅕ or about ⅕ of the length of the conductive substrate toward the center portion in the axis direction, Degree of curing=[Amount (g) of blocking agent separated from blocked isocyanate in undercoat layer]/weight of undercoat layer (g)×100.

2. The electrophotographic photoreceptor according to claim 1, wherein the degree of curing is about 1.1 or less in both the region A and the region B.

3. The electrophotographic photoreceptor according to claim 1, wherein a difference between the degree of curing in the region A and the degree of curing in the region B is about 0.5 or less.

4. The electrophotographic photoreceptor according to claim 1, wherein a difference between the degree of curing in the region A and the degree of curing in the region B is about 0.3 or less.

5. The electrophotographic photoreceptor according to claim 1, wherein the undercoat layer contains metal oxide particles.

6. The electrophotographic photoreceptor according to claim 5, wherein the metal oxide particles contain at least one metal oxide selected from the group consisting of titanium oxide, zinc oxide, aluminum oxide, silicon oxide, tin oxide, and zirconium oxide.

7. The electrophotographic photoreceptor according to claim 6, wherein the metal oxide particles are particles that have been surface-treated with at least one coupling agent selected from the group consisting of a silane coupling agent, a zirconium coupling agent, an aluminum coupling agent, and a titanium coupling agent.

8. The electrophotographic photoreceptor according to claim 1, wherein the electron-accepting substance is a dihydroxyanthraquinone-based compound.

9. A process cartridge detachably attachable to an image forming apparatus, comprising:

electrophotographic photoreceptor according to claim 1.

10. An image forming apparatus comprising:

electrophotographic photoreceptor according to claim 1;

a charging unit configured to charge a surface of the electrophotographic photoreceptor;

an electrostatic latent image forming unit configured to form an electrostatic latent image on the surface of the electrophotographic photoreceptor;

a development unit configured to develop the electrostatic latent image on the surface of the electrophotographic photoreceptor by using a developer containing a toner so as to form a toner image; and a transfer unit configured to transfer the toner image onto a surface of a recording medium.

* * * * *